US007186054B2

(12) United States Patent
Chambers

(10) Patent No.: US 7,186,054 B2
(45) Date of Patent: Mar. 6, 2007

(54) ANCHOR ASSEMBLY FOR A ROAD POST

(75) Inventor: Bryan Chambers, Townsville (AU)

(73) Assignee: Slider Guide Pty Ltd, Townsville (AU)

( * ) Notice: Subject to any disclaimer, the term of this patent is extended or adjusted under 35 U.S.C. 154(b) by 146 days.

(21) Appl. No.: 10/649,290

(22) Filed: Aug. 27, 2003

(65) Prior Publication Data

US 2005/0211866 A1 Sep. 29, 2005

(30) Foreign Application Priority Data

Aug. 30, 2002 (AU) ..... 2002951101

(51) Int. Cl.
*E01F 9/00* (2006.01)
*E01F 9/013* (2006.01)

(52) U.S. Cl. ..... 404/9; 404/10

(58) Field of Classification Search ..... 404/6, 404/9, 10, 11; 248/222.11; 40/606.01
See application file for complete search history.

(56) References Cited

U.S. PATENT DOCUMENTS

| | | | | | |
|---|---|---|---|---|---|
| 1,438,074 | A * | 12/1922 | Welch | 52/165 |
| 4,483,506 | A * | 11/1984 | Litwiller | 248/545 |
| 4,588,157 | A * | 5/1986 | Mills | 248/545 |
| 4,645,168 | A * | 2/1987 | Beard | 248/548 |
| 4,860,940 | A * | 8/1989 | Mills | 228/173.4 |
| 4,923,165 | A * | 5/1990 | Cockman | 248/545 |
| 5,123,623 | A * | 6/1992 | McNamara | 248/545 |
| 5,129,613 | A * | 7/1992 | Lloyd et al. | 248/222.11 |
| 5,230,187 | A * | 7/1993 | Reimann | 52/102 |
| 5,535,555 | A * | 7/1996 | Boyd et al. | 52/99 |
| 5,632,464 | A * | 5/1997 | Aberle | 248/530 |
| 6,263,601 | B1 * | 7/2001 | Emert | 40/564 |

FOREIGN PATENT DOCUMENTS

| | | |
|---|---|---|
| AU | 45599/96 | 8/1995 |
| AU | 778942 | 2/2002 |
| DE | 29716305 | 12/1997 |
| FR | 2705719 | 12/1994 |
| FR | 2737525 | 2/1997 |
| FR | 2772403 | 6/1999 |
| FR | 2804988 | 8/2001 |

* cited by examiner

*Primary Examiner*—Raymond W. Addie
(74) *Attorney, Agent, or Firm*—Fay Sharpe LLP

(57) ABSTRACT

A ground anchor assembly for a guide post, the ground anchor assembly having a first part and a second part, the first part adapted to be pounded into the ground, the first part comprising a head portion and a tail portion, the tail portion being insertable into the ground, the head portion comprising a flat plate attached to one end of the tail portion, the flat plate comprising a pair of folded over tab members defining a slot, the second part comprising a first wall to which a road post can be attached and a second wall which comprises a tongue member and which can be inserted into the slot on the first part to attach the first part to the second part.

15 Claims, 5 Drawing Sheets

ANCHOR ASSEMBLY FOR A ROAD POST

FIELD OF THE INVENTION

This invention is directed to an anchor assembly which can be used to attach a road post, a guidepost, any other type of post, or indeed any other type of member. The invention will be described with reference to a road post but it should be appreciated that no limitation is meant thereby.

BACKGROUND ART

Most roadways are provided with spaced apart road posts or guideposts.

These posts provide a visual indication of the edge of the road and are usually provided with a reflector to provide improved visibility. These posts are usually made of wood and have a length of between 1–2 m, a width of between 5–10 cm and a similar thickness. Sometimes, the posts are made of plastic or metal.

These road posts are typically spaced apart by distance of between 50–200 m which means that there are thousands of such posts on each side of a long-distance road.

It is often necessary to slash the roadside grass. A tractor mounted slasher is typically used for this process. It is necessary to ensure that the guideposts are kept clear of weeds to maintain visibility for the safety of motorists.

When the tractor slasher encounters a guidepost, the operator is forced to detour as closely around the post as possible. However, this always leaves a patch of grass or weed around the guidepost that the slasher cannot reach. Damage to the guidepost often occurs by the slasher accidentally striking the guidepost. This type of damage is most common when the guide post is manufactured of a plastics material or a thin metal material.

Typically, after the slasher has mowed the roadside grass, the patch of grass or weed around the guidepost is separately cut using a line trimmer and this requires additional labour and incurs additional cost. Alternatively, the grass or weed can be sprayed but this also incurs additional labour cost and can result in unacceptable environmental pollution.

Therefore, there would be an advantage if it was possible to quickly remove the roadside guidepost prior to mowing and then replace the guidepost. In this way, there would be no patch of grass/weed around the guidepost and it would not be necessary to spray the weeds or to use line trimmers. There would also be an advantage if the guide post assembly was such that when the guide post was removed, any remaining ground portion had a low-profile and would not strike the blades of the slasher.

Another disadvantage with guideposts is the quite laborious technique used is to insert a new guidepost into the ground. Typically, a hole is dug and the guidepost is placed in the hole. Sometimes, concrete is used to hold the guidepost in place. The hole is dug using a digging augur which is typically hydraulically operated and therefore requires a "bobcat" or similar machine. The guidepost is dropped into the hole and an operator must backfill the hole once the guidepost has been placed, and compact the loose earth around the post. Alternatively, the post is simply pounded into the ground. This latter technique requires an extremely strong post to be used.

With these conventional techniques, should a post become damaged or destroyed, it is difficult, time-consuming, and therefore quite expensive to replace the damaged or destroyed post.

Therefore, there would be an advantage if some form of anchor assembly could be developed which would allow a guidepost which has been damaged or which otherwise requires replacement to be more easily replaced. There would also be an advantage if an anchor assembly could be developed which could be more readily driven into the ground and especially without requiring any digging or excavation of the ground, but which also did not require pounding the road post itself thereby allowing the road post to be made of more flexible and thinner material such as plastic or thin metal (it being appreciated that flexible and thinner material as a road post will provide a greater level of safety should a motorist inadvertently strike the road post).

It is known to provide a road post having a post portion and some form of anchor portion. However, these existing devices suffer from disadvantages. The main disadvantages include a slow removal and reattachment of the post relative to the anchor portion, a configuration that results in soil and dirt falling into the anchor portion making it difficult to reattach the post or requiring initial cleaning of the anchor portion prior to reattachment of the post. Other known designs attempt to overcome the cleaning difficulty by having the anchor portion substantially proud of the ground surface but this makes it difficult to mow around the road post and makes it likely that the slasher blades will strike the anchor portion which may damage the anchor portion or blades.

If a road post is to have an anchor portion that can be separated from the post portion, it is necessary to ensure to the post portion is securely fastened to the anchor portion and does not wobble or move. The reason for this is that the road post will usually be provided with a reflector and if the post moves (for instance under windy night time conditions), this can result in the reflector moving causing confusion to a passing motorist.

Australian patent application 455 99/96 describes a post stump apparatus which is more suited to a semipermanent attachment of the post. Removal and reattachment of the post is slow and labourious. Moreover, the portion of the assembly which is in the ground can easily fill with dirt making attachment and removal of the post quite difficult.

German patent specification 29716305 describes a road post anchor which has a portion extending from the ground surface and therefore presenting a striking hazard for slasher blades. Moreover, the portion of the assembly which is in the ground can easily fill with dirt making attachment and removal of the post quite difficult.

French patent specification 2705719 appears to rely upon gravity to hold the post in place which is not reliable and is not acceptable. Moreover, the portion of the assembly which is in the ground can easily fill with dirt making attachment and removal of the post quite difficult. The citation has a boxlike ground engaging portion which does not lend itself to be pounded into the ground and this portion will therefore requiring initial excavation of the ground which is undesirable.

French patent specification 2737525 has a boxlike ground engaging portion which does not lend itself to be pounded into the ground and this portion will therefore requiring initial excavation of the ground which is undesirable. Although the citation appears to illustrate the ground portion being pounded into the ground, this will be difficult if not impossible in the extremely hard road base. Moreover, the portion of the assembly which is in the ground can easily fill with dirt making attachment and removal of the post quite difficult.

French patent specification 2804988 appears to illustrate some form of collar which extends substantially above the ground surface and to which the post member is attached via some sort of intermediate member. The collar will be a striking hazard for slasher blades. Moreover, if the collar is filled with dirt, it will be difficult to attach the post member.

French patent specification 2772403 has a plate member driven into the ground. The plate member is provided with guides and a post is slid into the guides. If the guides are even partially filled with dirt, it will be extremely difficult to insert and remove the post.

Therefore, the main disadvantages with these posts is that they do not lend themselves to be pounded into hard ground (by being boxlike or tubular in construction), they often have a projecting portion extending above the ground to fit the road post (becoming a striking hazard) or have some form of cavity or recess or guide in which the post member must pass (which requires prior cleaning especially if dirt and debris falls into the cavity) all of which makes these devices not particularly suitable for use along a road where it may be necessary to quickly remove and attach hundreds or thousands of road posts during a slasher operation.

It will be clearly understood that, if a prior art publication is referred to herein, this reference does not constitute an admission that the publication forms part of the common general knowledge in the art in Australia or in any other country.

OBJECT OF THE INVENTION

It is an object of the invention to provide an anchor assembly for a guidepost which may at least partially overcome the above-mentioned disadvantages or provide the consumer with useful or commercial choice.

In one form, the invention resides in a ground anchor assembly for a guide post, the ground anchor assembly having a first part and a second part, the first part being adapted to be pounded into the ground, the first part comprising a head portion and a tail portion, the tail portion being insertable into the ground, the head portion comprising a flat plate attached to one end of the tail portion, the flat plate comprising a pair of folded over tab members defining a slot, the second part comprising a first wall to which a road post can be attached and a second wall which comprises a tongue member and which can be inserted into the slot on the first part to attach the first part to the second part.

In a broader form, the invention resides in an anchor assembly for a guidepost, the anchor assembly comprising a first part and a second part, the first part adapted to be pounded into the ground, the second part adapted for attachment to a guidepost, the second part including a tongue member, the first part including a slot, the tongue member being receivable in the slot to releasably attach the second part to the first part.

In this manner, a guidepost can be attached to the second part and the second part can be releasably attached to the first part. The first part is typically pounded into the ground to provide an anchor, and the second part, by being attached to the first part, provides a mount for the guidepost. Should the guidepost become damaged or otherwise require replacement, the second part can be removed from the first part typically by a strong blow or kick. As the first part is pounded into the ground before the second part is connected, this allows the second part to be connected to plastic or thin metal guide posts, as it is not necessary to pound the guide post itself into the ground.

Moreover, by having the attachment of the first part and the second part substantially at ground level, when the second part (and therefore the guidepost) is removed, the area can be mowed or slashed without there being any abutment/projection etc which can strike the blades of the slasher. The only "projection" will be the folded over tab members and these will project from the ground surface by no more than 5–10 millimeters which will not result in a striking hazard.

Thus, prior to mowing, the operator can simply kick the guidepost away from attachment to the first part, can then mow the area, and can then replace the guideposts. Spraying using chemicals, or the requirements of separate line trimmers is not required. The assembly does not have any boxlike or tubular portion which can fill with dirt and debris and therefore reattachment of the guide post is simple and easy. If any dirt is present in the folded tab members, this dirt will be pushed out as the tongue member on the second part is pushed in between the tab members. The assembly according to the invention is robust and can handle quite rough use as it is expected that the guide post will be kicked out and kicked back into position, typically by a hard blow on the first wall of the second part.

In a broad form, the invention comprises an anchor assembly for an elongate member the anchor assembly comprising a first part adapted for insertion into the ground, and a second part adapted for attachment to the elongate member, the second part being releasably attached to the first part.

Suitably, the first part comprises a member (tail portion) which can be pounded into the ground. For this reason, the first part is typically made of steel. The member is preferably formed from angled flanges to minimise movement once the first part is in the ground, and to facilitate pounding the member into the ground. Thus, the member, in one form, may be V or L shaped. When pounded into the ground, this particular shape minimises movement of the first part. However, it should be appreciated that the member may comprise other configurations to facilitate penetration into the ground and to reduce in ground movement. These may comprise a U shaped member etc.

The first part may be made of steel plate having a thickness of between 2–10 mm. If the tail portion is V shaped, the length may be between 10–50 cm, and the width may be between 5–20 cm. It should be appreciated however that no limitation is meant thereby.

The first part may be formed from a single plate of steel which can be bent to form the desired configuration.

Suitably, the first part is formed with a head portion which may comprise a top wall. The top wall may comprise a flat steel plate which is welded or otherwise attached to the tail portion. Alternatively, the head portion may comprise a folded over portion of the tail portion instead of being formed separately and welded or otherwise attached to the tail portion. The top wall may have a thickness of between 2–10 millimeters.

The top wall may have various configurations. For instance, the top wall may be substantially rectangular, oval, or part circular. It is preferred that the top wall is sufficiently large to provide a pounding surface to enable the first part to be hammered into the ground surface.

The top wall may comprise a slot or other type of means to allow the second part to be connected to the first part. The slot may comprise a full slot, a partial slot and the like. In an example, the slot may comprise a pair of folded tab portions extending slightly above the top wall and defining a spacing into which the tongue member or portion of the second part can pass.

It is preferred that the slot and the tongue member are arranged such that the tongue member is frictionally engaged in the slot. This prevents the tongue member from inadvertently being removed from the first portion. It is preferred that the fictional engagement is such that a sharp blow (such as a kick or a hammer blow) can remove the tongue member from the slot.

If desired, the slot arrangement may contain some form of means to facilitate frictional engagement with the tongue member and/or the tongue member may contain some form of means to facilitate frictional engagement within the slot. For instance, the means may comprise one or more projections/buttons/ribs/abutment and the like.

The second part may comprise a metal plate or metal sheet which can be bent/cut or otherwise configured to form the desired shape. In a preferred form, the second part is substantially L-shaped in configuration. Thus, the second part may comprise a first portion and a second portion which are typically substantially at right angles to each other. The second portion may contain or may comprise the tongue member. The tongue member typically comprises a substantially rectangular part. The first portion may comprise a wall and may be substantially flat and may be adapted for attachment to the bottom of a guidepost or other type of elongate member, or any other type of member which may benefit from attachment to the particular assembly. The first portion may comprise attachment means. The attachment means in a simple form may comprise one or more openings extending through the first portion to allow fasteners to fasten the guidepost to the first portion. Alternatively, the attachment means may comprise bolts which are attached to the second part.

It is also envisaged that the second part may be formed integrally with the road post or elongate member. In this form, the second part may be formed of plastics material or thin metal material. To provide a better locking or attachment of the second part to the first part, locking tabs or projections may be provided on the second part.

BRIEF DESCRIPTION OF THE DRAWINGS

Two embodiments of the invention will be described with reference to the following figures in which.

BEST MODE

Figure 1:
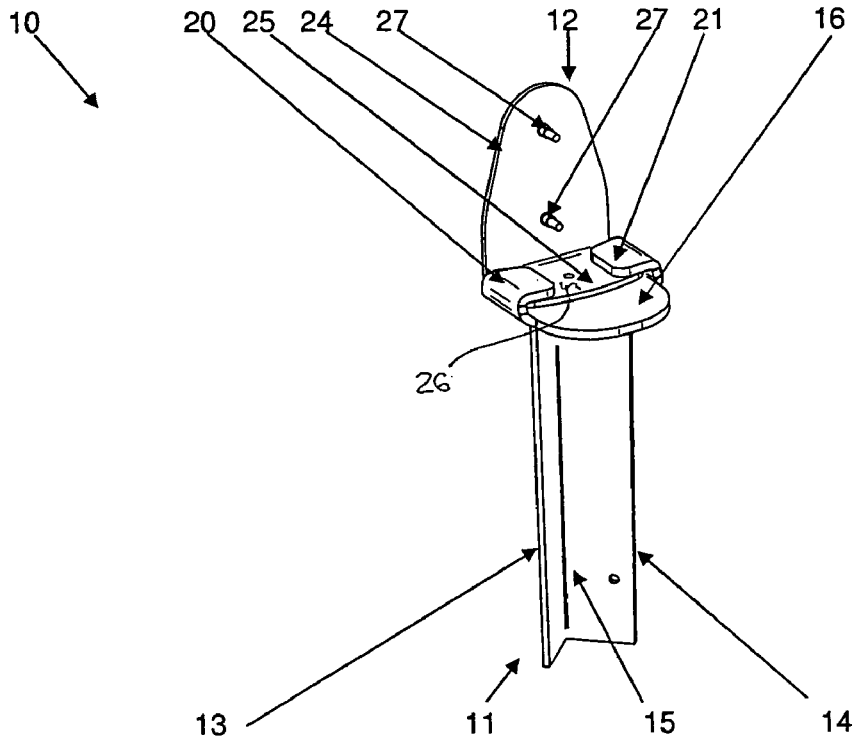
FIG. 1. Illustrates a perspective view of an anchor assembly according to an embodiment of the invention.
Figure 2:
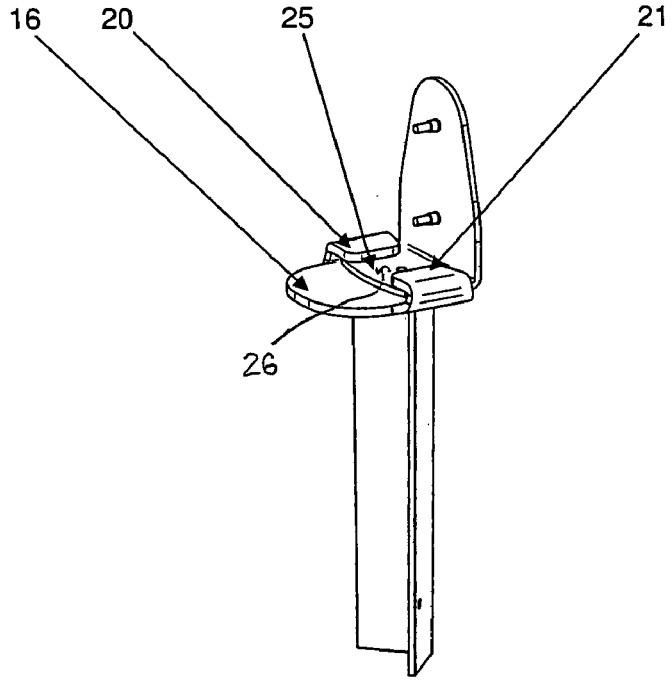
FIG. 2. Illustrates the assembly of FIG. 1 from the other side.
Figure 3:
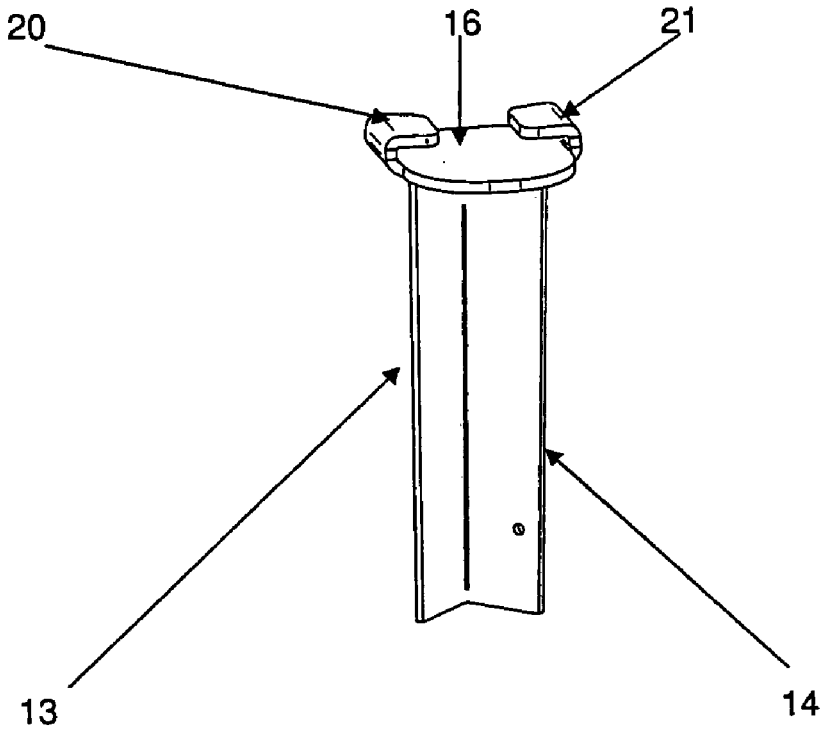
FIG. 3. Illustrates the first part in substantially side view.
Figure 4:
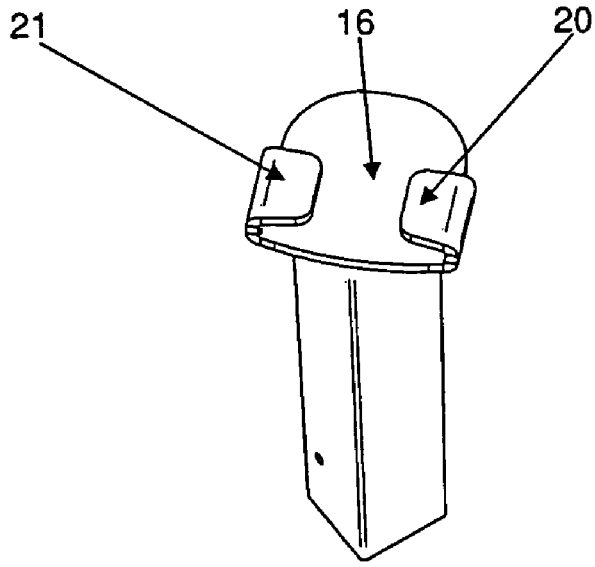
FIG. 4. Illustrates a close-up view of the top wall of the second part.
Figure 5:
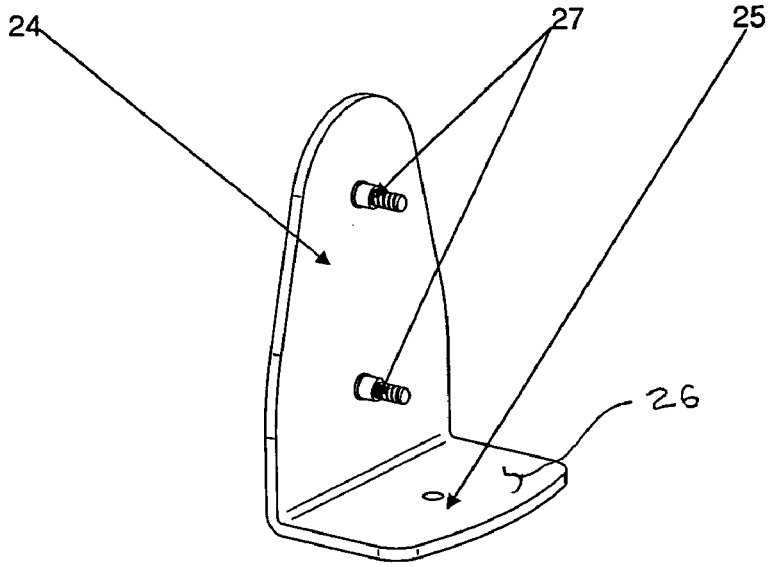
FIG. 5. Illustrates a view of the second part.
Figure 6:
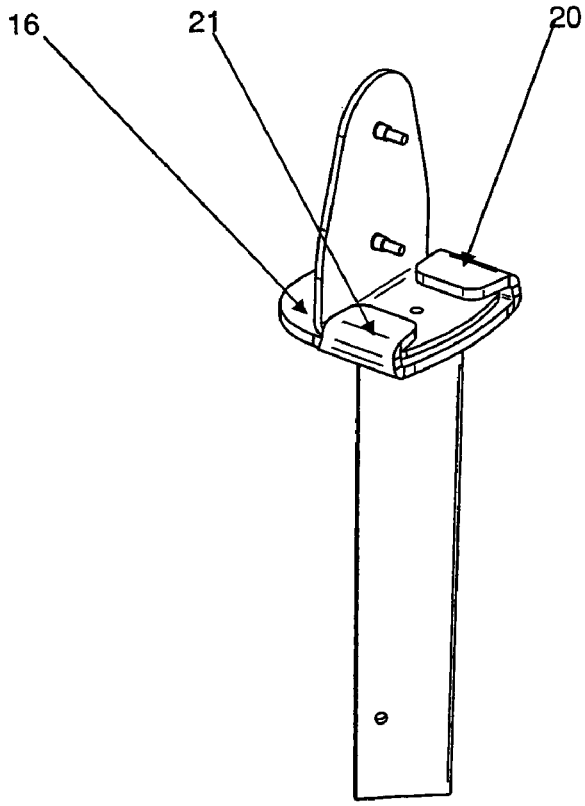
FIG. 6. Illustrates a view of the second part attached to the first part in a manner opposite to that illustrated in FIG. 1.

Referring to the drawings, and initially to FIGS. 1–6 (first embodiment) there is illustrated an anchor assembly 10 which in this particular embodiment comprises only two parts being a first part 11 and a second part 12. Referring initially to first part 11, this comprises a tail portion 15 which is manufactured from a single sheet of steel typically having a thickness of between 3–8 mm.

The steel may be galvanised or otherwise treated to reduce corrosion. The single sheet of steel is bent such that the tail portion 15 is substantially V or L shaped in configuration and comprises a pair of sidewalls 13, 14. A top wall 16 is formed separately and is welded to the top of sidewalls 13, 14. The length of the first part can vary but in the particular embodiment is between 20–60 cm. The width of each sidewall can vary, but in the particular embodiment is between 2–10 cm and about 4 cm. The configuration allows the first part to be pounded into the ground and once in the ground, prevents unwanted movement.

Top wall 16 comprises a separate metal plate which is welded to the tail portion 15. The size of the top wall is such that it projects outwardly from each sidewall 13, 14 to provide a desirably large platform for attachment of the second part 12 to the first part 11. In the embodiment, top wall 16 is part circular and has a length of about 100 millimeters and a width of about 90 millimeters. The top wall is provided with a pair of integrally formed tabs 20, 21 which are folded over to define a slot. Each tab 20, 21 is spaced slightly above top wall 16 by a spacing which approximates the thickness of the steel of second part 12 such that second part 12 can frictionally engage with the inner walls of each tab 20, 21 and top wall 16.

In use, first part 11 can be hammered into the ground such that top wall 16 is adjacent the ground surface. This means that if second part 12 is not attached, a mower can pass over the top of first part 11 without the mower blades striking any portion of the first part.

Second part 12 comprises a single metal sheet which is bent to form a substantially L-shaped configuration comprising a first portion 24 and a second portion 25. First portion 24 is a wall adapted for attachment to a guidepost or similar member and therefore may comprise a flat portion formed with a number of bolts 27 to allow attachment to a guidepost [not illustrated]. The length of first portion 24 can vary but in the embodiment is between 10–20 cm. The width of the first portion 24 can vary but in the embodiment is between 5–15 cm. The thickness of the first portion 24 can vary but in the embodiment is between 1.5–4 mm.

The second portion 25 forms the tongue member 26 of the second part 12. Thus, tongue member 26 has a length to allow it to pass into the slot defined by tabs 20, 21. The length is typically between 1–10 cm.

In use, a guidepost can be attached to the second part 12 via the first portion 24. The guidepost and the second part 12 can then be fitted to first part 11 by pushing tongue member 26 into the slot defined by tabs 20, 21. If desired, a small grub screw (not illustrated) can pass through opening 28 in the tongue member 26 to more securely attach the guidepost to the first portion 11.

When the area needs to be mowed, an operator can simply kick out tongue member 26 from engagement in the slot. The mower can then pass over the top of first part 11 with no damage. The guidepost can then be replaced by kicking tongue member 26 back into the slot. Similarly, if the guidepost has been damaged and requires repair or replacement, it can be simply removed without needing to remove first part 11 which can stay in the ground. Should the guidepost be hit by a motor vehicle, the guidepost will normally be pushed out of engagement in the slot. If the slot tabs 20, 21 have been prized open, they can be hammered back into position.

Another advantage of the anchor assembly is that it is not necessary to pound guideposts directly into the ground. This means that the guideposts can be made of plastics material, thin metal and the like, which can provide improved safety to motorists. The installation cost is less.

Figure 7:
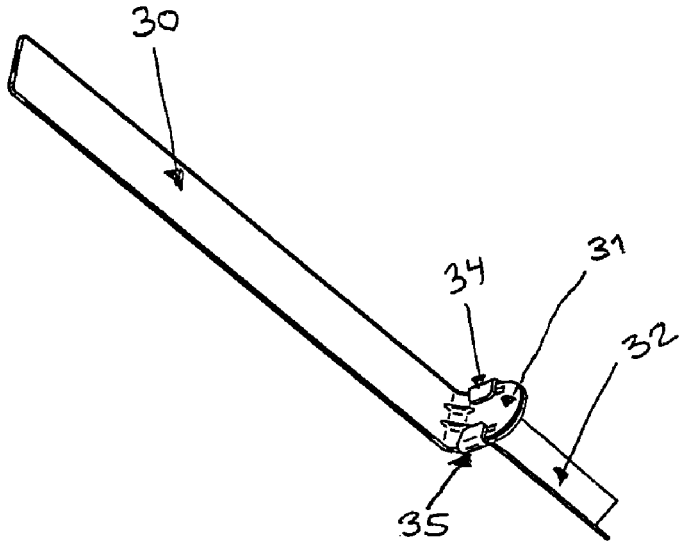
FIGS. 7–10. Illustrate a second embodiment of the invention which comprises a plastic integrally formed second part attached to a first part.
Figure 8:
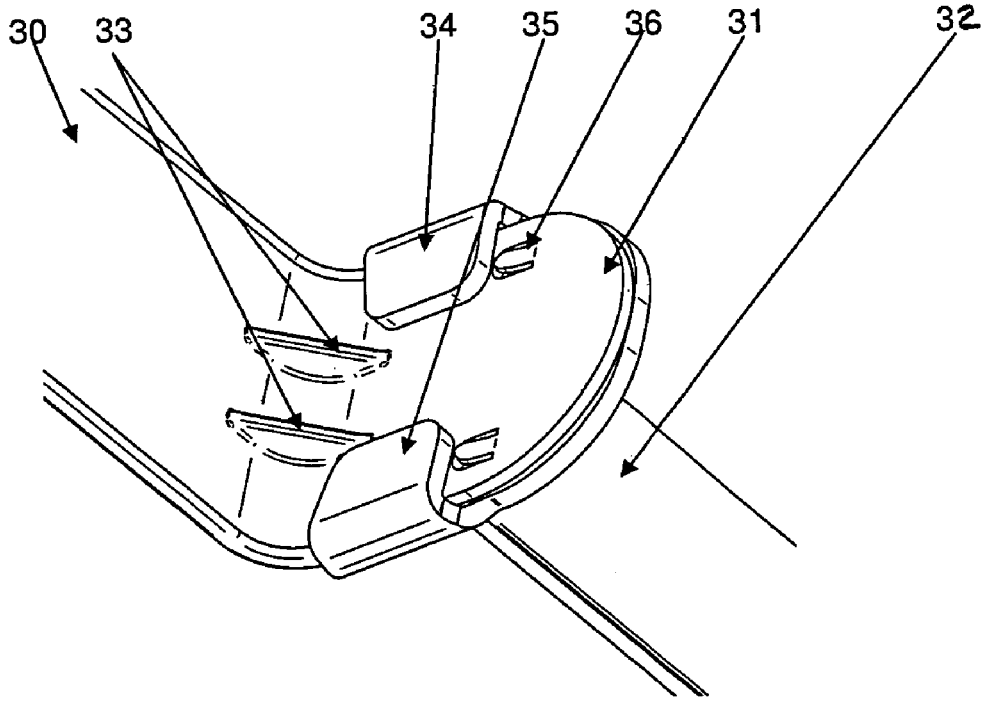
Figure 9:
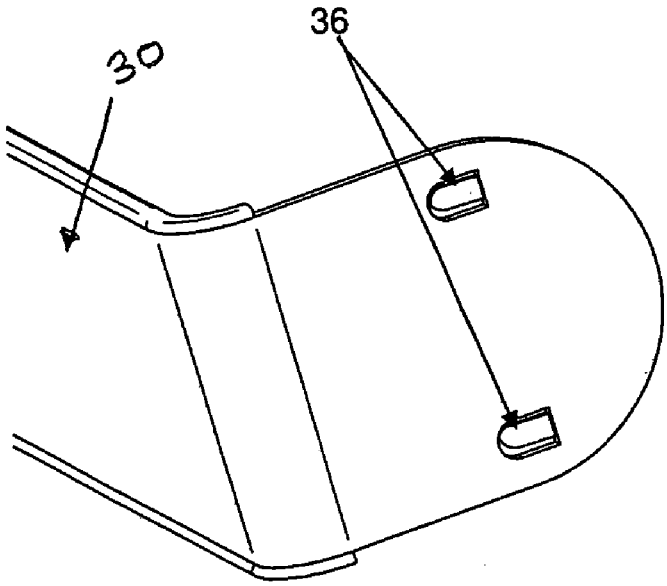
Figure 10:
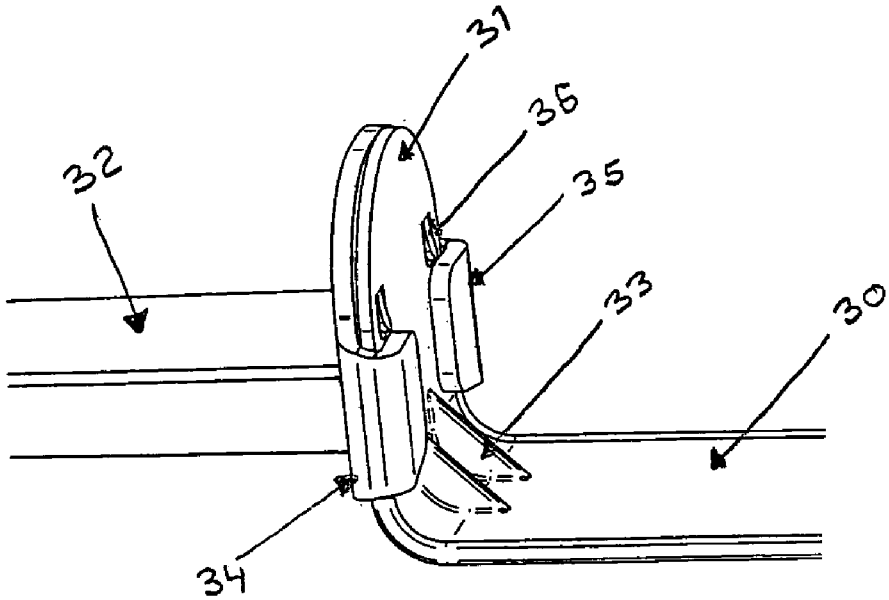

Referring to the second embodiment illustrated in FIGS. 7–10, this is similar to the first embodiment described above except that the second part is formed integrally wit the road post 30. typically, the road post 30 is made of plastics material. The lower end of the road post is L-shaped and comprises a tongue member 31 which passes between the tabs 34, 35, these being similar to that described above. As the road post 30 can be made of substantially thin material, reinforcement brackets 33 are provided to maintain rigidity to the post. To positively attach the road post to the first part 32 a pair of locking fingers 36 is provided which extend into respective openings (see FIG. 10) to more securely hold the two parts together. Thus, to remove the two parts it is initially necessary to depress the locking fingers (typically by standing on them) and then removing the road post 30 from between the tabs 34, 35.

It should be appreciated that various other changes and modifications can be made to any embodiment described without departing from the spirit and scope of the invention.

The invention claimed is:

1. A ground anchor assembly for a guide post, the ground anchor assembly having a first part and a second part, the first part pounded into the ground, the first part comprising a head portion and a tail portion, the tail portion including a longitudinal axis and being insertable into the ground wherein the tail portion is V shaped or L-shaped in configuration and comprises a first side wall and a second side wall extending at an angle in relation to the first side wall and wherein the first and second side walls extend along the longitudinal axis to enable the tail portion to be pounded into the ground, the head portion comprising a flat plate attached to one end of the tail portion, the flat plate comprising a pair of folded over tab members defining a slot, the second part comprising a first wall to which a road post can be attached and a second wall which comprises a tongue member and which can be inserted into the slot on the first part to attach the first part to the second part, wherein the second part can be quickly detached from and reattached to the first part with a firm blow.

2. The assembly as claimed in claim 1, wherein the tail portion has a length of between 10–50 centimeters.

3. The assembly as claimed in claim 1, wherein the head portion is part circular in configuration.

4. The assembly as claimed in claim 1, wherein the tongue member has a curved front edge.

5. An anchor assembly for a guidepost, the anchor assembly comprising a first part and a second part, wherein the first part is substantially V shaped or L-shaped in configuration and comprises a first side wall and a second side wall extending substantially along a longitudinal axis of the first part, the second part adapted for attachment to a guidepost, the second part including a tongue member, the first part including a slot, the tongue member being receivable in the slot to enable the second part to be quickly attached to and detached from the first part with a firm kick.

6. The assembly as claimed in claim 5 wherein the second part is formed integrally with the guide post.

7. The assembly as claimed in claim 6, comprising locking fingers on one of the first part or second part engaging in openings on the other of the first part or second part.

8. The assembly as claimed in claim 5, wherein the first part includes a head portion which is part circular in configuration.

9. The assembly as claimed in claim 5, wherein the tongue member has a curved front edge.

10. The assembly as claimed in claim 5, wherein the first part includes a tail portion which has a length of between 10–50 centimeter.

11. An anchor assembly for a guidepost, the anchor assembly comprising:

a first part comprising a head portion and a tail portion, the tail portion including a V-shaped or L-shaped section which can be pounded into the ground, the head portion comprising a flat plate attached to one end of the tail portion, the flat plate comprising a pair of folded over tab members defining a slot;

a second part comprising a first wall and a second wall which comprises a tongue member and which can be inserted into the slot on the first part to attach the first part to the second part; and, wherein the tongue member comprises a locking finger which cooperates with one of said pair of folded over tabs to selectively hold the second part to the first part.

12. The assembly as claimed in claim 11, wherein the head portion is part circular in configuration.

13. The assembly as claimed in claim 11, wherein the tongue member has a curved front edge.

14. The assembly as claimed in claim 11, wherein the tail portion has a length of between 10–50 centimeters.

15. The assembly as claimed in claim 11, further comprising a reinforcement bracket located on the second part.

* * * * *